US012096867B2

(12) United States Patent
Navarro et al.

(10) Patent No.: US 12,096,867 B2
(45) Date of Patent: Sep. 24, 2024

(54) MERCHANDISER

(71) Applicant: Hussmann Corporation, Bridgeton, MO (US)

(72) Inventors: Moisses Navarro, Rancho Cucamonga, CA (US); Anand Ganesh Rajagopalan, Irvine, CA (US); Sandeep Palaksha, Maryland Heights, MO (US); Al Arrosagaray, Rancho Cucamonga, CA (US); Alex J. Evdokimoff, Murrieta, CA (US)

(73) Assignee: Hussmann Corporation, Bridgeton, MO (US)

( * ) Notice: Subject to any disclaimer, the term of this patent is extended or adjusted under 35 U.S.C. 154(b) by 138 days.

(21) Appl. No.: 17/410,892

(22) Filed: Aug. 24, 2021

(65) Prior Publication Data

US 2021/0378421 A1 Dec. 9, 2021

Related U.S. Application Data

(62) Division of application No. 16/316,151, filed as application No. PCT/US2017/041259 on Jul. 7, 2017, now Pat. No. 11,096,504.

(Continued)

(51) Int. Cl.

| | |
|---|---|
| ***A47F 3/04*** | (2006.01) |
| *F25D 17/08* | (2006.01) |
| *F25D 23/02* | (2006.01) |

(52) U.S. Cl.

CPC ..... *A47F 3/0417* (2013.01); *A47F 3/0434* (2013.01); *A47F 3/0443* (2013.01);

(Continued)

(58) Field of Classification Search

CPC .... A47F 3/0417; A47F 3/0434; A47F 3/0443; A47F 3/0447; F25D 17/08; F25D 23/023; F25D 2317/067; F25D 2317/0671

See application file for complete search history.

(56) References Cited

U.S. PATENT DOCUMENTS

| | | | |
|---|---|---|---|
| 2,936,596 | A | 6/1960 | Rainwater |
| 3,462,966 | A | 8/1969 | Reid et al. |

(Continued)

FOREIGN PATENT DOCUMENTS

| | | | |
|---|---|---|---|
| JP | 5926578 | S | 2/1984 |
| JP | S59-26578 | U | 2/1984 |

(Continued)

OTHER PUBLICATIONS

International Search Report and Written Opinion for Application No. PCT/US2017/041259 dated Oct. 24, 2017, (9 pages).

(Continued)

*Primary Examiner* — Joseph F Trpisovsky

(74) *Attorney, Agent, or Firm* — Michael Best & Friedrich LLP

(57) ABSTRACT

A refrigerated merchandiser including a case having a first case section. The first and second case sections define first and second product display areas. The first case section further defines an air passageway and the second case section includes a glass panel. The air passageway supports a fan and is in fluid communication with a first airflow inlet and a second airflow outlet. An airflow flows through the first airflow outlet toward the evaporator and a second airflow outlet in communication with the first airflow inlet via an evaporator bypass channel. A first airflow portion flows through the first airflow outlet and is cooled by the evaporator, and a second airflow portion flows through the second airflow outlet to bypass the evaporator and is uncooled by the evaporator. The second airflow outlet (Continued)

directs the second airflow portion over an exterior of the glass panel of the second case section.

12 Claims, 19 Drawing Sheets

Related U.S. Application Data

(60) Provisional application No. 62/360,166, filed on Jul. 8, 2016.

(52) U.S. Cl.
CPC ..... *A47F 3/0447* (2013.01); *F25D 17/08* (2013.01); *F25D 23/023* (2013.01); *F25D 2317/067* (2013.01); *F25D 2317/0671* (2013.01)

(56) References Cited

U.S. PATENT DOCUMENTS

| | | | | |
|---|---|---|---|---|
| 4,325,227 | A | 4/1982 | Ibrahim | |
| 4,644,758 | A | 2/1987 | Maehara et al. | |
| 4,750,335 | A | 6/1988 | Wallace et al. | |
| 5,606,863 | A | 3/1997 | Kicklighter et al. | |
| 5,675,983 | A | 10/1997 | Ibrahim | |
| 6,094,931 | A * | 8/2000 | Jeong | F25D 17/065 454/193 |
| 6,151,904 | A | 11/2000 | Zin et al. | |
| 6,539,741 | B2 | 4/2003 | Navarro | |
| 7,162,882 | B2 * | 1/2007 | Alahyari | A47F 3/0447 62/89 |
| 2002/0184904 | A1 | 12/2002 | Wellman | |
| 2003/0172670 | A1 | 9/2003 | Vormedal | |
| 2006/0207279 | A1 * | 9/2006 | Daddis | F25D 17/062 62/255 |
| 2013/0213074 | A1 | 8/2013 | Nguyen et al. | |
| 2014/0216090 | A1 | 8/2014 | Strupp | |

FOREIGN PATENT DOCUMENTS

| | | | |
|---|---|---|---|
| JP | 11137382 | A | 5/1999 |
| JP | 2002098466 | A | 4/2002 |
| WO | 2009061318 | A1 | 5/2009 |
| WO | 2011047291 | A1 | 10/2010 |

OTHER PUBLICATIONS

Turbo air, "Display Cases, Deli Cases, Installation and Operation Manual," Retrieved on May 12, 2017 from: http://www.webstaurantstore.com/documents/pdf/902td4r.pdf, (16 pages).

New Zealand Patent Office Examination Report for Application No. 749763 dated Jun. 13, 2019 (3 pages).

* cited by examiner

MERCHANDISER

CROSS-REFERENCE TO RELATED APPLICATIONS

This application is divisional of U.S. application Ser. No. 16/316,151, filed Jan. 8, 2019, now U.S. Pat. No. 11,096,504, which is a national phase application filing of International Patent Application No. PCT/US2017/041259, filed Jul. 7, 2017, which claims the benefit of and priority to U.S. Provisional Application No. 62/360,166, filed on Jul. 8, 2016, the entire contents of each of which are incorporated herein by reference.

BACKGROUND

The present invention relates to refrigerated merchandisers, and more particularly to refrigerated merchandisers including serviced and self-service sections.

Refrigerated merchandisers generally include a case defining a product display area for supporting and displaying products to be visible and accessible through an opening in the front of the case. Refrigerated merchandisers are generally used in retail food store applications such as grocery or convenient stores or other locations where product is displayed and often refrigerated. Some merchandisers include a service section via which consumers can view product and receive assistance from store personnel in selecting product, as well as self-service section via which consumers can select the product without assistance.

SUMMARY OF THE INVENTION

In one embodiment, the present invention provides a refrigerated merchandiser including a case having a first case section. The first case section defines a first product display area and an air passageway. The air passageway supports a fan and is in fluid communication with an airflow inlet and an airflow outlet. The air passageway is at least partially defined by a refrigeration system including an evaporator. A portion of the air passageway is further defined by a plenum having a stepped profile configured to channel and adjust a direction of an airflow within the first air passageway prior to entering the evaporator.

In another embodiment, the stepped profile of the plenum includes a plurality of sections joined by a plurality of bends, wherein each section alternates between relatively small increases in elevation and relatively large increases in elevation such that the airflow is efficiently directed from a first airflow path to a second airflow path generally perpendicular to the first airflow path within the first air passageway.

In another embodiment, the stepped profile of the plenum is configured to distribute air more evenly across the evaporator to enhance cooling efficiency.

In another embodiment, the refrigerated merchandiser includes a case having first and second case sections. The first and second case sections define first and second product display areas. The first case section further defines an air passageway and the second case section includes a glass panel. The air passageway supports a fan and is in fluid communication with a first airflow inlet and a second airflow outlet. The air passageway is at least partially defined by a refrigeration system including an evaporator. The refrigerated merchandiser further includes an airflow configured to flow through the first airflow outlet toward the evaporator and a second airflow outlet in communication with the first airflow inlet via an evaporator bypass channel. The airflow is separated into a first airflow portion and a second airflow portion. The first airflow portion is configured to flow through the first airflow outlet and cooled by the evaporator and the second airflow portion is configured to flow through the second airflow outlet to bypass the evaporator and to be uncooled by the evaporator. The second airflow outlet directs the second airflow portion over an exterior of the glass panel of the second case section.

In another embodiment, the evaporator bypass channel is at least partially defined between the evaporator and a wall separating the first case section and the second case section.

In another embodiment, the evaporator bypass channel further includes a heater positioned in the evaporator bypass channel, wherein second airflow portion is directed over the heater before exiting at the second airflow outlet.

In another embodiment, the refrigerated merchandiser includes a case having a first case section. The first case section defines a first product support area and an air passageway. The air passageway supports a fan and is in fluid communication with an airflow inlet and an airflow outlet. The air passageway is at least partially defined by a refrigeration system including an evaporator. The airflow outlet is defined by a discharge grill having a plurality of discharge segments, in which each discharge segment is angled relative to at least one of the other plurality of discharge segments to direct an airflow to different portions of the case.

In another embodiment, each discharge segment of the plurality of discharge segments includes a plurality of apertures.

In another embodiment, the sum of the plurality of apertures differs for each of the plurality of discharge segments such that different volumes of air are discharged by the plurality of discharge segments.

In another embodiment, at least one of the shape and size of the plurality of apertures differs for each of the plurality of discharge segments such that air is discharged by the plurality of discharge segments at different velocities.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
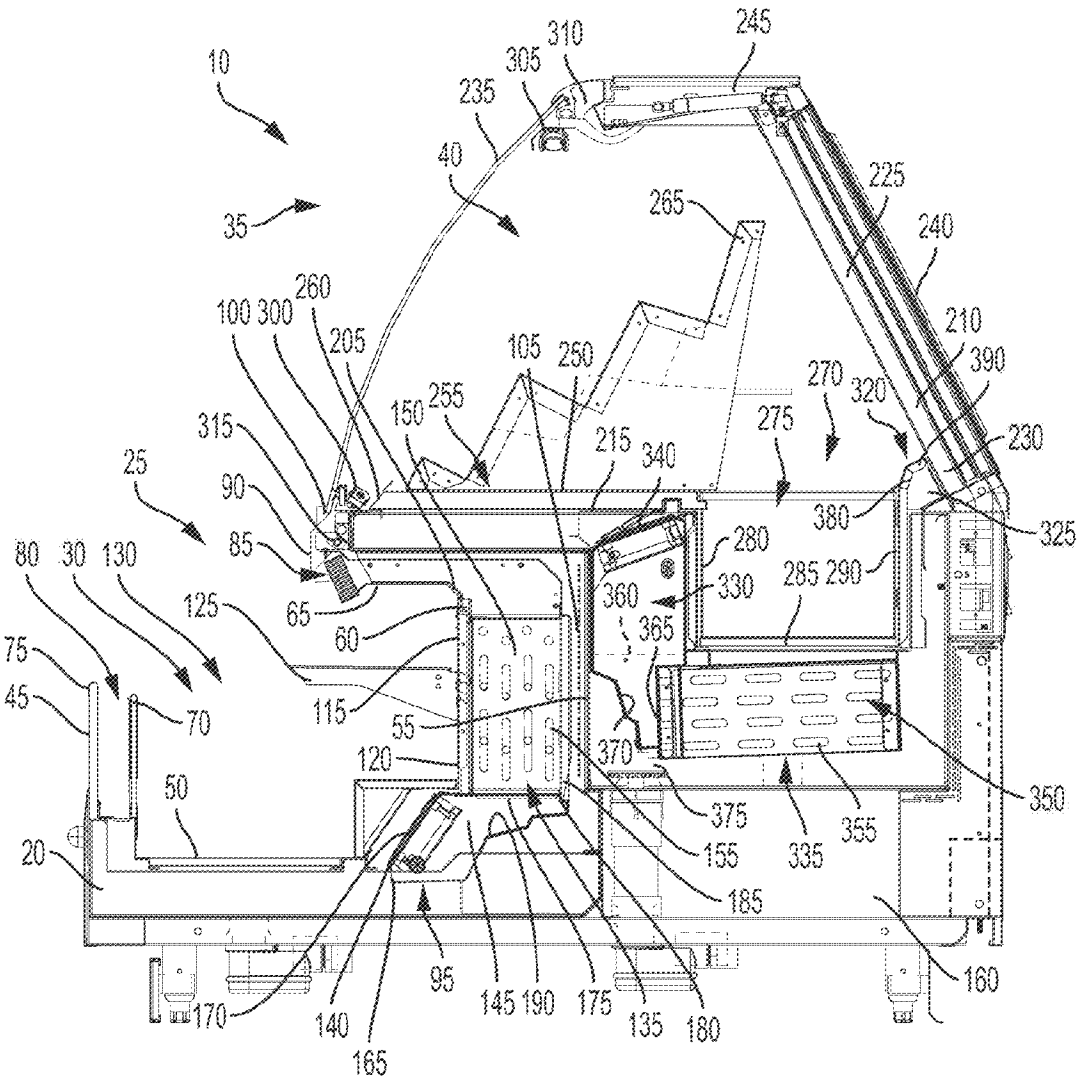
FIG. 1 is side view of a merchandiser embodying the present invention and illustrating first and second case sections.
Figure 2:
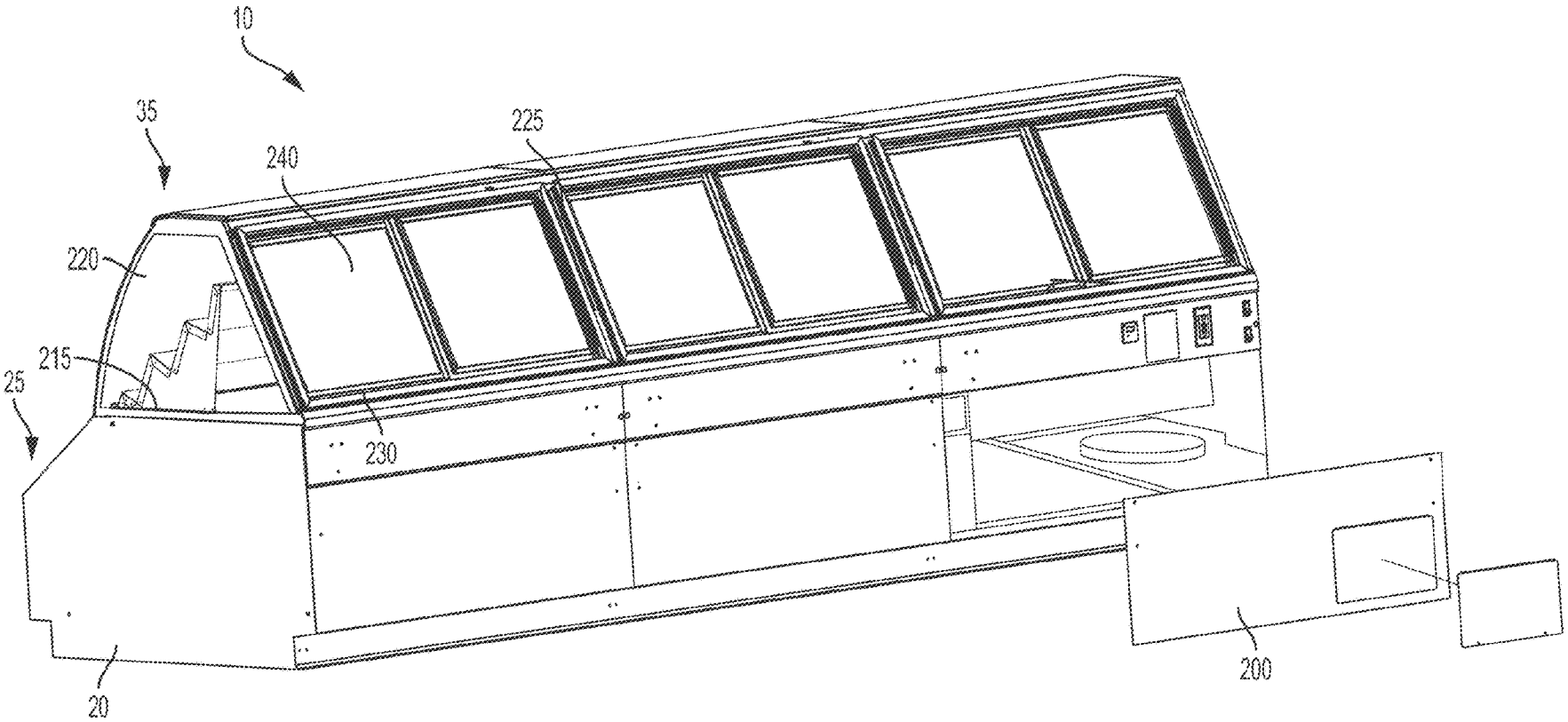
FIG. 2 is a rear perspective view of the merchandiser of FIG. 1.
Figure 3:
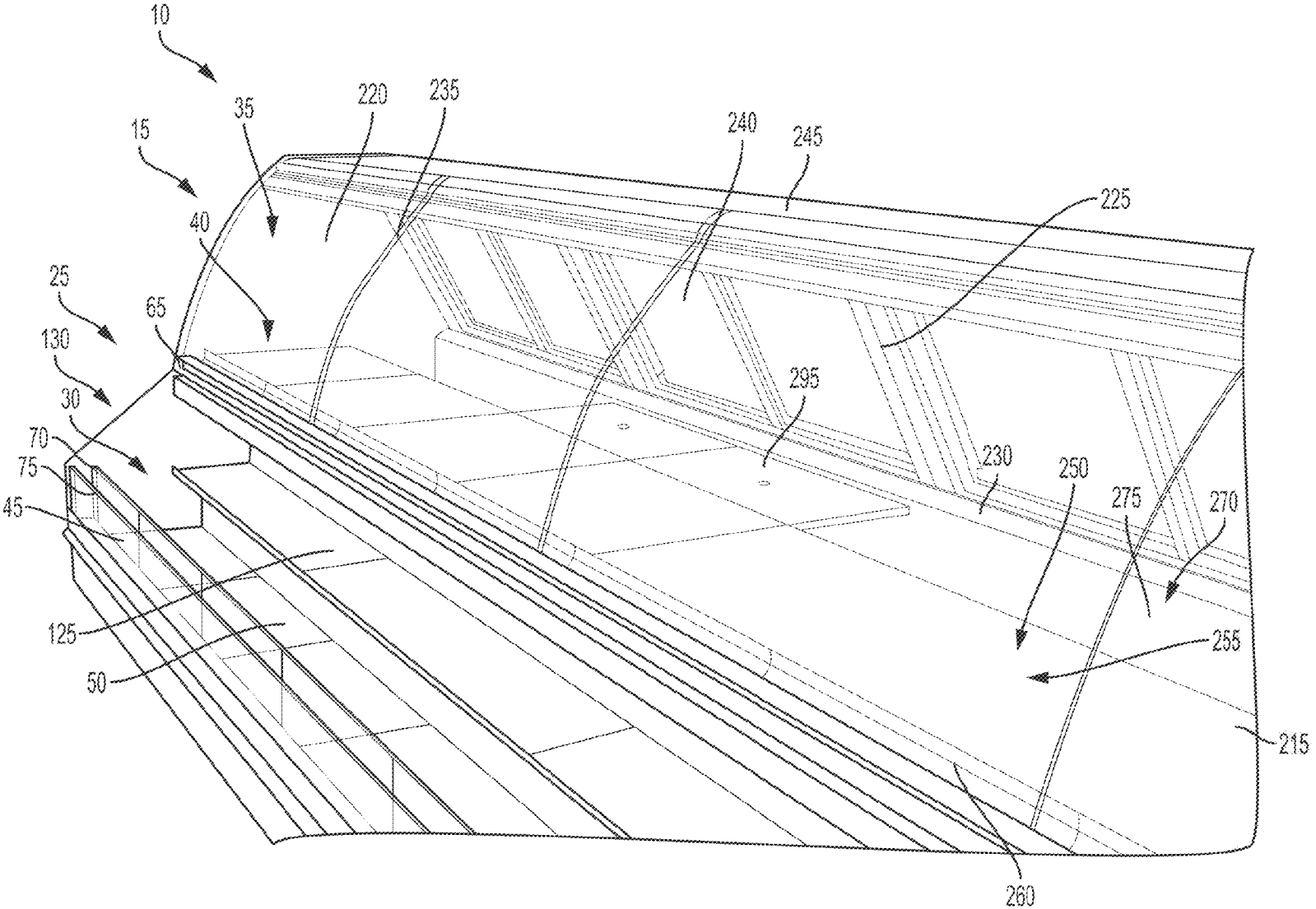
FIG. 3 is a front perspective view of a portion of the merchandiser of FIG. 1.

FIGS. 1-3 illustrate an exemplary merchandiser 10 that may be located in a supermarket or a convenience store or other retail settings (not shown) for presenting fresh food, beverages, and other product (not shown) to consumers. The illustrated merchandiser 10 is a horizontal merchandiser (e.g., a meat, bakery, or deli-type merchandiser) and includes a case 15. The case 15 has a base 20 and is defined by a first case section 25 (e.g., a self-service portion of the merchandiser 10) with a first product support area or product display area 30 (referred to as a "first product display area" for purposes of description only), and a second case section 35 (e.g., a serviced portion of the merchandiser 10) with a second product support area or product display area 40 (referred to as a "second product display area" for purposes of description only). The base 20 supports both case sections 25, 35. The merchandiser 10 may be coupled to or otherwise aligned with other merchandisers 10 to form a large, continuous product display area with discrete or continuous first and second case sections 25, 35. This may be altered in other embodiments to shape a set of merchandisers 10 within a space according to customer needs.

Figure 8:
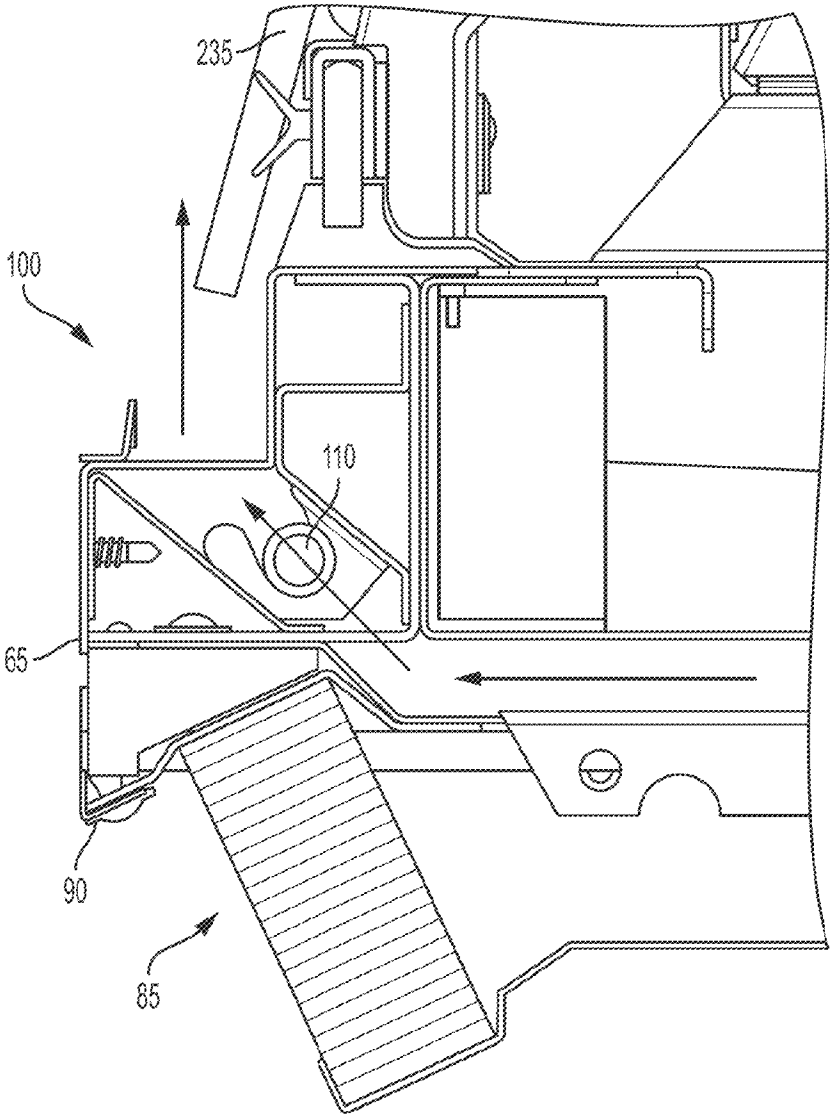
FIG. 8 is an enlarged view of a portion of the first case section and a portion of the second case section illustrating an air guide section.

The first case section 25 includes a front portion 45 extending upward from the base 20, a lower surface 50, a divider wall 55, a rear panel 60, and a top portion or first canopy 65 that is coupled to the base 20 and that is cantilevered over the first product display area 30. The front portion 45, the lower surface 50, the rear panel 60, and the first canopy 65 cooperatively define the first product display area 30. The front portion 45 includes an inner guard 70 spaced from an outer guard 75 to define a first airflow inlet 80 therebetween. The first canopy 65 defines a first airflow outlet 85 that is in fluid communication with the first airflow inlet 80 via a first air passageway 95. The first canopy 65 has an upper edge 90 that is disposed adjacent and downstream of the outlet 85 to minimize turbulent air flow exiting the outlet 85. The first canopy 65 also defines a heated airflow outlet 100 that is in communication with the first airflow inlet 80 via a bypass channel 105. A heater 110 (e.g., calrod) is supported by the first canopy 65 within or adjacent the heated airflow outlet 100 (FIG. 8). The rear panel 60 is spaced apart from the divider wall 55 to partially define the first air passageway 95 and the bypass channel 105. In addition, the rear panel 60 includes upper airflow apertures 115 and lower airflow apertures 120 that are in fluid communication with the first airflow inlet 80. With reference to FIGS. 1, 3, 4A, 4B, and 5, one or more product supports 125 (e.g., shelves) can be coupled to and extend forward from the rear panel 60 to support product in the first product display area 30. The first product display area 30 is accessible through an opening 130 adjacent a front of the merchandiser 10.

Figure 4A:
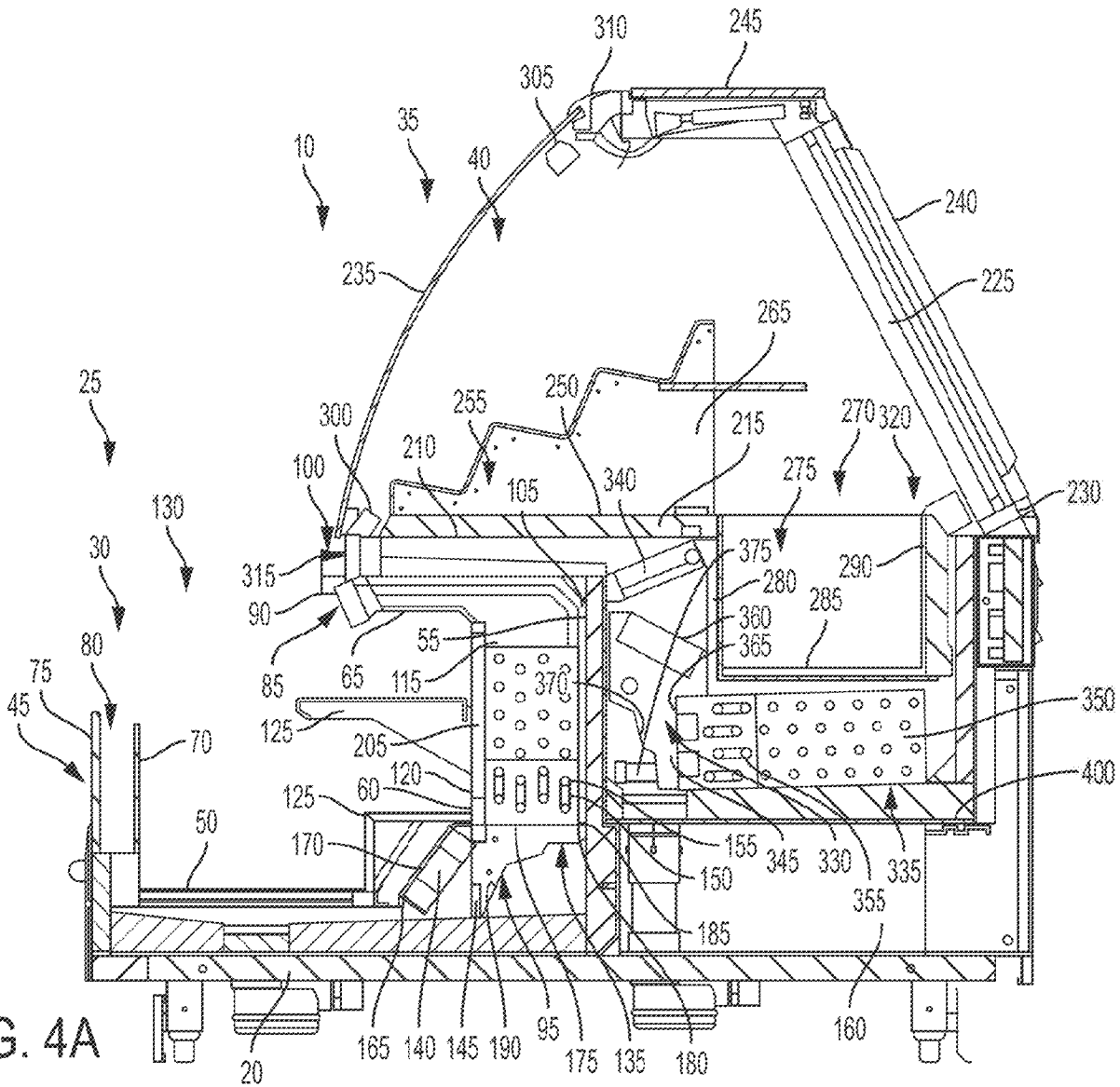
FIG. 4A is a section view of the merchandiser of FIG. 1 taken along line 3-3 and illustrating features of the first case section and the second case section.
Figure 4B:
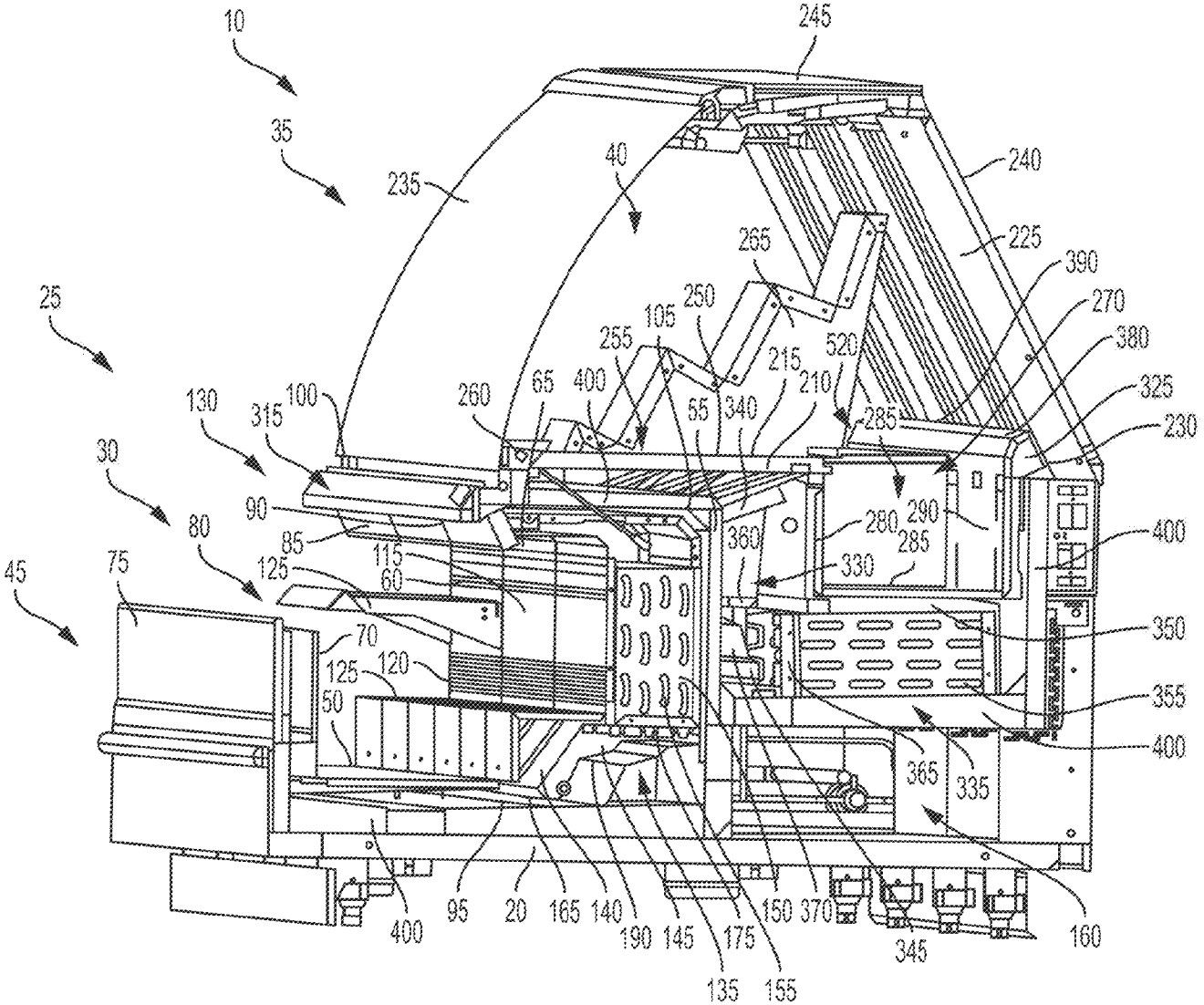
FIG. 4B is a perspective view of the merchandiser of FIG. 4A.

The merchandiser 10 also includes at least a portion of a first refrigeration system 135 that circulates a heat transfer fluid (e.g., refrigerant, coolant, etc.) to cool air within the first air passageway 95 in order to refrigerate product supported within the first product display area 30. Portions of the first refrigeration system 135 are supported by the base 20 within the first air passageway 95. As seen in FIGS. 1, 4A, and 4B, the first refrigeration system 135 includes at least a fan 140, a plenum 145, and an evaporator 150 having refrigeration coils 155.

The first refrigeration system 135 further includes a compressor (not shown) to circulate the heat transfer fluid between a condenser and/or heat exchanger (not shown), a receiver (not shown), and the refrigeration coils 155 of the evaporator 150. These components of the first refrigeration system 135 may be supported within the merchandiser 10, or may be a peripheral (remote) component. In one example, the compressor, condenser, heat exchanger, and receiver may be supported within a compartment 160 in the base 20 to the rear of the first case section 25 (e.g., to the right in FIGS. 1, 4A, and 4B) and beneath the second case section 35. The first refrigeration system 135 can include other components depending on design parameters and the conditioning needs for which the first refrigeration system 135 is being used.

Figure 5:
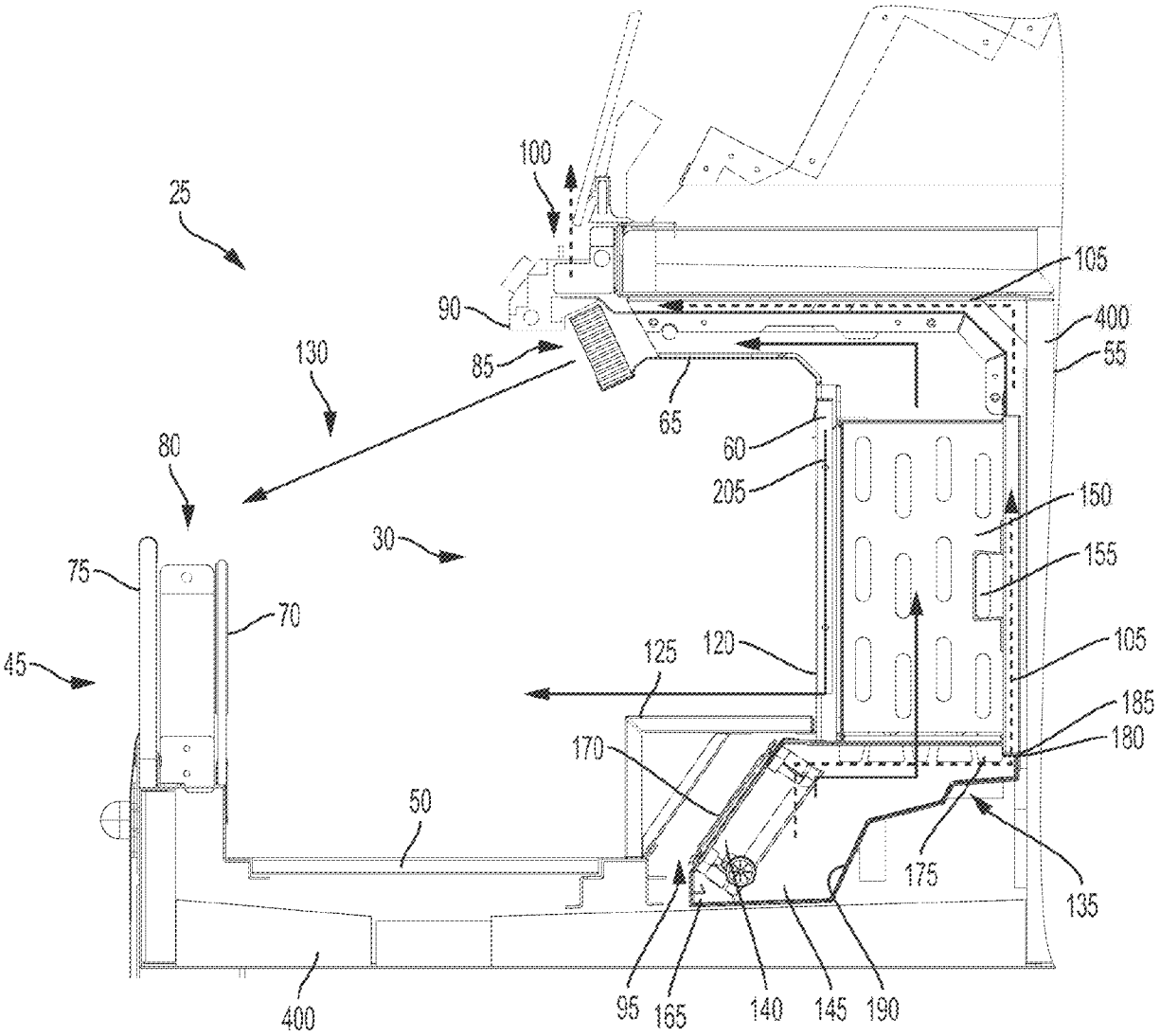
FIG. 5 is a section view of the first case section of FIGS. 3 and 4, illustrating a first product display area, shelves in the display area, airflow paths through the first case section, and a portion of a first refrigeration system.

With reference to FIGS. 4A and 4B, the fan 140 is disposed within the first air passageway 95 upstream of the evaporator 150, although the fan 140 can be positioned downstream of the evaporator 150. As illustrated, fan 140 is positioned at an inlet 170 to the plenum 145, which extends downstream from the fan 140 and defines a portion of the first air passageway 95 that connects to the vertical portion of the passageway 95. The plenum 145 includes a fluid outlet 165, a plenum inlet 170, a first plenum outlet 175 that is fluidly coupled to the evaporator 150, and a second plenum outlet 180 that is fluidly coupled to a bypass channel inlet 185. As illustrated in FIGS. 4A, 4B, and 5, the fan 140 is positioned at or adjacent the inlet 170 to the plenum 145, which extends downstream from the fan 140 and defines a portion of the first air passageway 95 that connects to the vertical portion of the passageway 95.

Figure 5A:
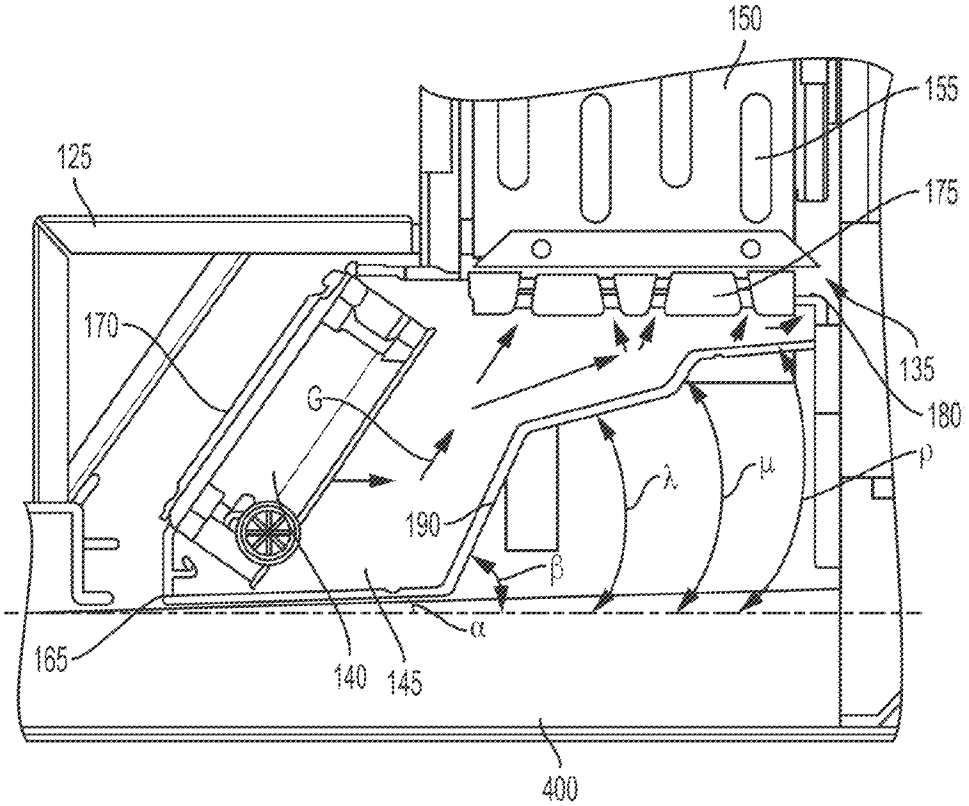
FIG. 5A is an enlarged view of a portion of the first case section of FIG. 5 illustrating a plenum of the first refrigeration system having a stepped surface.
Figure 5B:
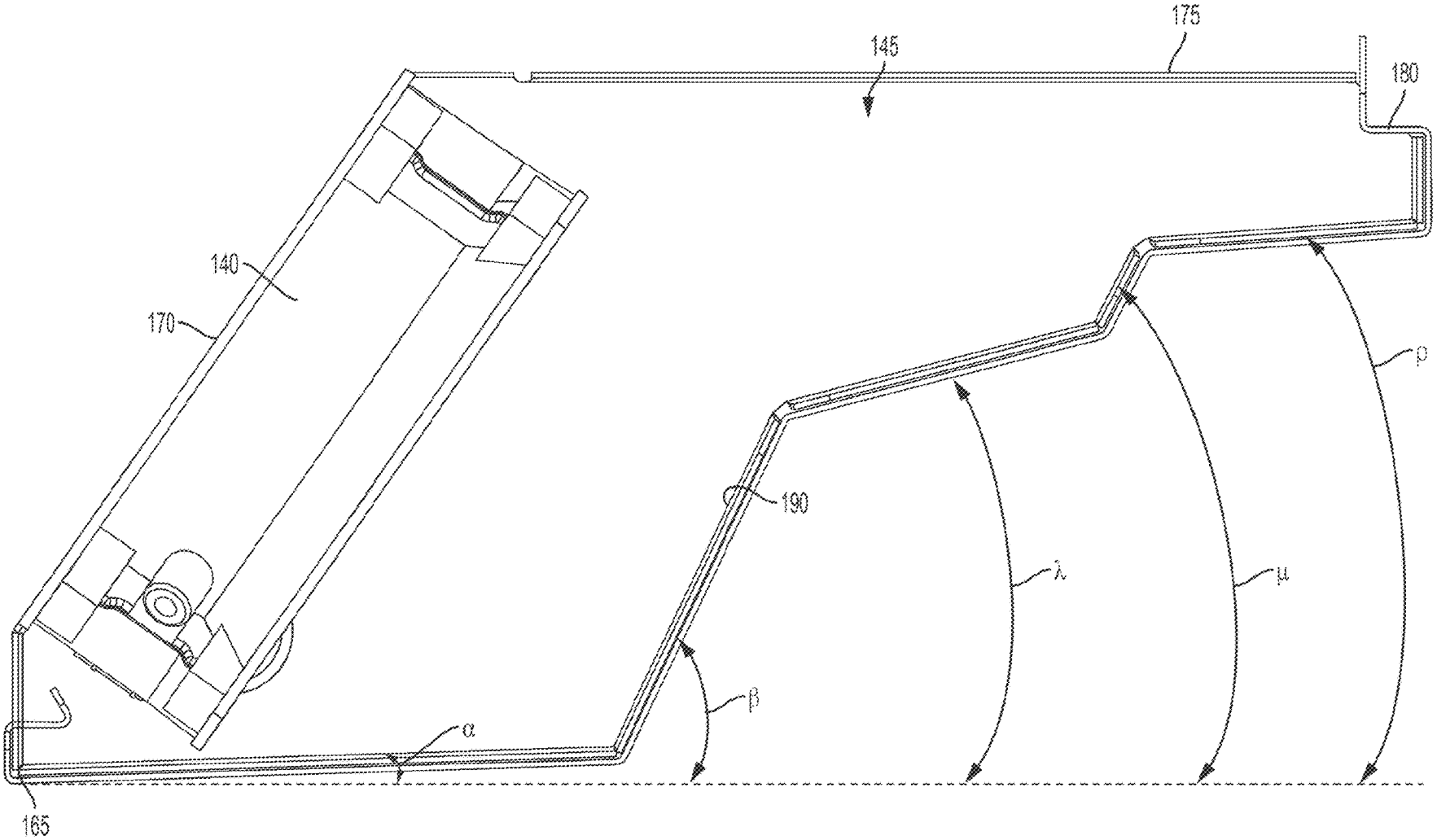
FIG. 5B is side view of the plenum of FIG. 5A.

As best illustrated in FIGS. 5, 5A and 5B, the plenum 145 generally tapers or narrows in the downstream direction from the inlet 170 (i.e. moving in the airflow direction along the first air passageway 95). More specifically, a lower wall 190 that defines a portion of the plenum 145 (and the passageway 95) has several sections with bends joining the sections such that the lower wall 190 has a stepped profile. With reference to an imaginary horizontal plane extending through the forward-most part of the plenum 145 (at the outlet 165), a first section of the lower wall 190 is oriented at a non-zero angle $\alpha$ (e.g., 1-10 degrees) to promote drainage of condensate from the plenum 145. A second section extends upward from the first section and is oriented at an angle $\beta$ of approximately 60 degrees relative to the horizontal plane. A third section extends further upward from the second section and is oriented at an angle $\lambda$ of approximately 10-45 degrees relative to the horizontal plane. A fourth section extends further upward from the third section and is oriented at an angle $\mu$ of approximately 60 degrees relative to the horizontal plane. A fifth section extends further upward from the fourth section and is oriented at an angle $\rho$ of approximately 10-30 degrees relative to the horizontal plane. More generally, the stepped profile of the illustrated lower wall 190 alternates between sections that have relatively small increases in elevation and sections that have relatively large increases in elevation so that the airflow is efficiently directed from a generally horizontal flow to a vertical flow within the passageway 95. In the context of the angle $\alpha$, the angle $\beta$, the angle $\lambda$, the angle and the angle $\rho$, the term "approximately" means plus or minus five degrees (e.g. the angle $\beta$ is 60±5 degrees in FIG. 5A).

Figure 6:
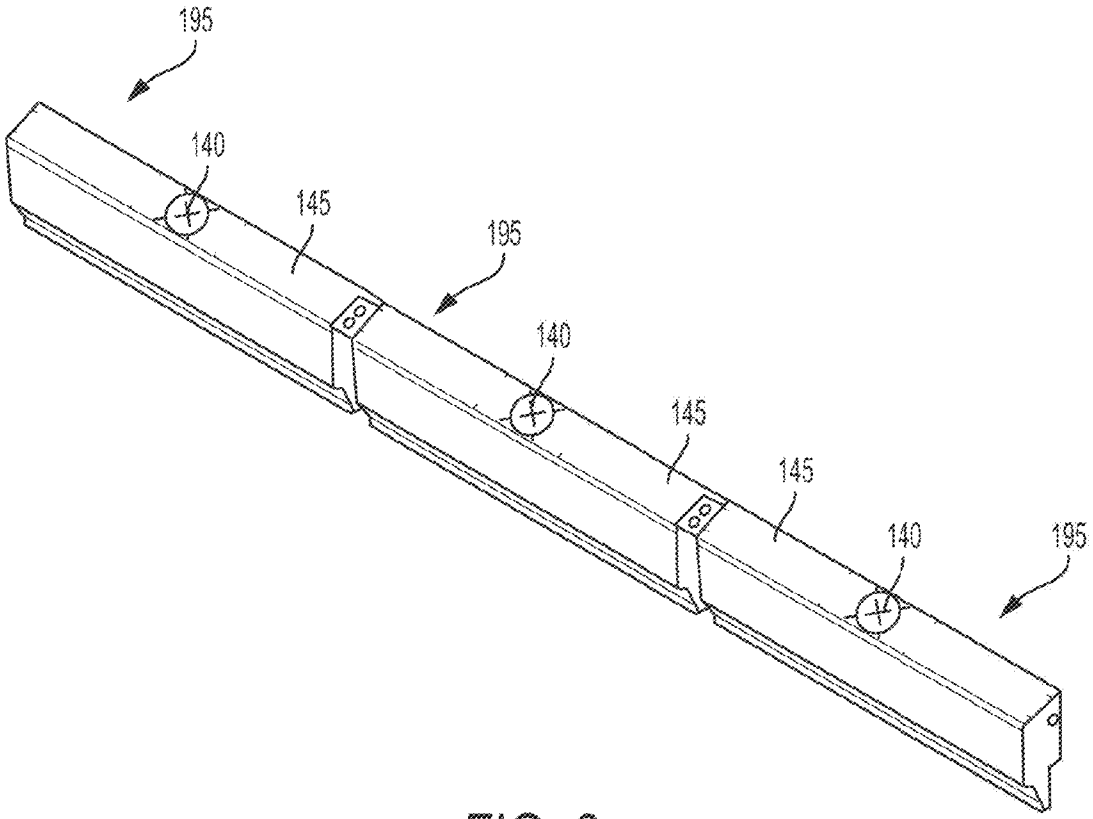
FIG. 6 is a perspective view of a modular fan assembly of the merchandiser of FIG. 1.

As illustrated in FIG. 6, the fan 140 may be coupled to or supported at least partially within the plenum 145 such that each fan 140/plenum 145 cooperatively defines a modular fan unit 195. Multiple fan units 195 are supported within the merchandiser 10. Each fan unit 195 is individually removable from the merchandiser 10, which permits servicing and/or replacement of individual fan units 195. With reference to FIG. 2, each fan unit 195 may be accessed via a door or removable panel 200 on the merchandiser 10 such that a service technician may access the fan units 195 without having to remove an excessive number of other parts.

Figure 7:
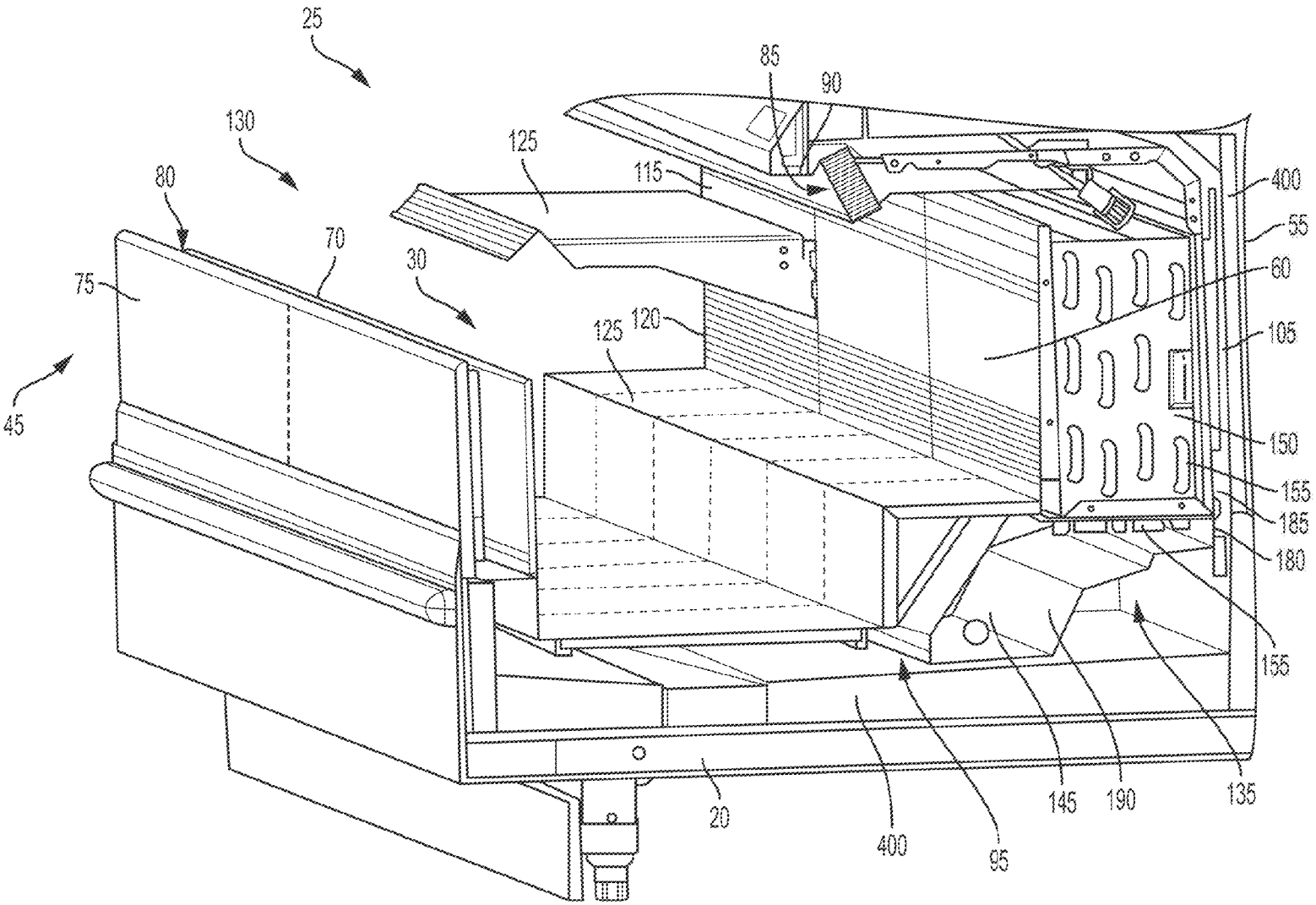
FIG. 7 is an enlarged perspective view of a portion of the first case section illustrating one of the shelves and panels that permit airflow into the first product display area, and exposing an evaporator and a plenum of the first refrigeration system.

With reference to FIG. 5, the evaporator 150 and the bypass channel inlet 185 are disposed downstream from the plenum 145. In the illustrated embodiment, an inlet of the evaporator 150 is coupled to the plenum 145 at the first plenum outlet 175 and is disposed behind the rear panel 60. The bypass channel inlet 185 is formed at the second plenum outlet 180 such that the bypass channel 105 is at least partially defined between the evaporator 150 and the divider wall 55. With reference to FIGS. 5 and 7, the rear panel 60 includes the upper and lower airflow apertures 115, 120 that are in airflow communication air exiting the evaporator 150 within the passageway 95 via a gap passageway 205 defined between the rear panel 60 and another panel positioned adjacent (e.g., coupled to) the evaporator 150.

Referring to FIG. 1, the second case section 35 includes a frame 210 with a support wall 215, lateral supports 220, frame uprights 225 that extend upward and forward (toward the left in FIG. 1) from the base 20, and a second canopy 245 that extends forward from and is cantilevered to the uprights 225. The second canopy 245 supports a first glass panel 235 at the front of the merchandiser 10, and the uprights 225 support second glass panels 240 to enclose the second product display area 40.

Referring to FIGS. 1, 3, 4A, and 4B, the support wall 215 defines a lowermost display surface 250 of the second product display area 40. As shown in FIGS. 1, 4A, and 4B, the support wall 215 has a first portion 255 that is disposed adjacent a front edge 260 of the second case section 35 (FIG. 3) and that is configured to support a shelving unit 265 (FIGS. 1, 4A, 4B). The display surface 250 also includes a second portion 270 that is continuous with the first portion 255 and that defines a recessed well 275 (e.g., 11 inches wide by 8 inches deep) adjacent a rear side of the merchandiser 10 (toward the right in FIGS. 1, 4A, 4B). The well 275 is defined by a first sidewall 280, a recessed wall 285, and a second sidewall 290. The well 275 also can include a cover or door 295 that encloses the well 275. When the door 295 is arranged or positioned to enclose the well 275, the first and second portions 255, 270 cooperatively define a continuous display surface 250. For purposes of the description and the claims, the continuity provided by the first and second portions 255, 270 is intended to encompass small gaps or seams that may be formed between the first portion 255 and the door 295.

As illustrated, the first glass panel 235 is coupled to second canopy 245 and extends downward and is coupled to the support wall 215 to enclose a front side of the second case section 35. The first glass panel 235 can be pivotally attached to the second canopy 245 such that the panel 235 is movable between open and closed positions, or fixed to the second canopy 245 such that the panel 235 is generally immovable after installation.

The second glass panels 240 are coupled to the uprights 225 adjacent the rear edge 230 to enclose the rear side of the merchandiser 10. The second glass panels 240 form doors that provide access to the second product display area 40 from adjacent the rear of the case 15. For example, the panels 240 may be slidably attached to the uprights 225 or pivotally coupled to the uprights 225.

The second case section 35 includes a first light element 300 (e.g., an LED light or an array of LED lights, etc.) that is disposed adjacent the support wall 215, and a second light element 305 coupled to the second canopy 245 to illuminate the product display area 40. Each light element 300, 305 can include light emitting diodes ("LEDs") or other forms of light-emitting elements that can illuminate the display area 40. Also, each light element 300, 305 can be movable or adjustable (e.g., pivotable, slidable, etc.) to modify the direction or focus of light. A light shield 310 is positioned adjacent the second canopy 245 to limit or inhibit light being directed toward a customer who is positioned adjacent a front of the case. An exemplary light element for the elements 300, 305 can include the adjustable light mechanism described and illustrated in U.S. Patent Application Publication No. 2015/0233549 (assigned to Hussmann Corporation), filed on Feb. 13, 2015, which is incorporated by reference herein. As will be appreciated, the light elements 300, 305 can take other forms.

Figure 10:
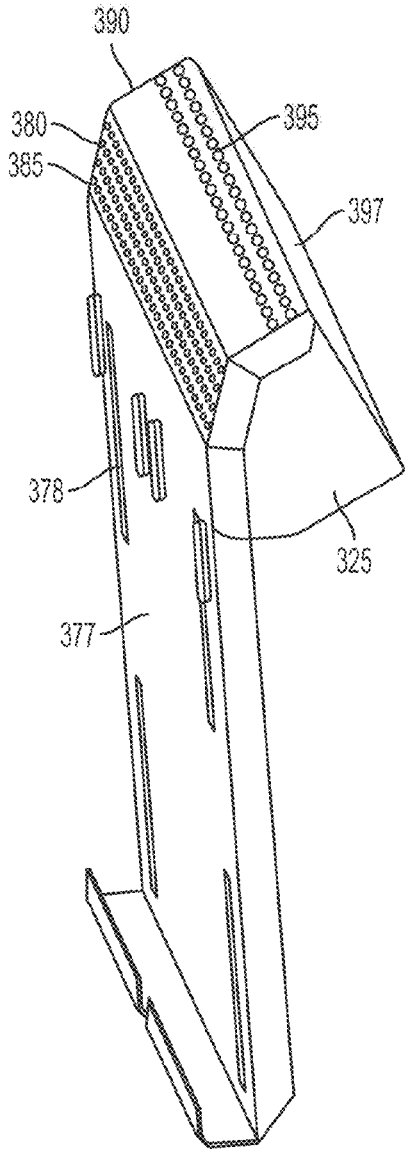
FIG. 10 is a perspective view of an exemplary air discharge grill of the second case section shown in FIGS. 4A, 4B.

With reference to FIGS. 4A and 4B, the second case section 35 includes a second airflow inlet 315 that is located adjacent the front of the second case section 35 and that is defined between the first canopy 65 and the support wall 215. The second airflow inlet 315 is fluidly coupled to a second airflow outlet 320 via a second air passageway 330. As best shown in FIGS. 4B and 10, the second airflow outlet 320 is defined by a discharge grill 325. The second air passageway 330 is generally defined by a between the first case section 25 or the base 20 of the merchandiser 10 and the support wall 215 of the second case section 35. As shown in FIGS. 4A, 4B, the second air passageway 330 extends horizontally from the second airflow inlet 315, downward between the first sidewall 280 of the well 275 and the divider wall 55, horizontally below the lower surface 285 of the well 275, and upward along the second sidewall 290 of the well 275 to the discharge grill 325.

The second case section 35 also includes a second refrigeration system 335 that circulates a heat transfer fluid (e.g., refrigerant, coolant, etc.) to cool air within the second air passageway 330 in order to refrigerate product supported within the first product display area 30. Portions of the second refrigeration system 335 are supported by the support wall 215 within the second air passageway 330 at least partially between the divider wall 55 and the support wall 215. As seen in FIG. 1, 4A, and 4B, the second refrigeration system 335 includes at least a fan 340, a plenum 345, and an evaporator 350 having refrigeration coils 355.

The second refrigeration system 335 further includes a compressor (not shown) to circulate the heat transfer fluid between a condenser and/or heat exchanger (not shown), a receiver (not shown), and the refrigeration coils 355 of the evaporator 350. These components of the second refrigeration system 335 may be supported within the merchandiser 10, or may alternatively be a peripheral element. They may also be shared components with the first refrigeration system 135—for example, the compressor may circulate a heat transfer fluid within each of the first refrigeration system 135 and the second refrigeration system 335. As one of ordinary skill in the art will appreciate, the second refrigeration system 335 can include other components depending on design parameters and the conditioning needs for which the refrigeration system is being used.

With continued reference to FIGS. 4A and 4B, the fan 340 is disposed within the second air passageway 330 upstream of the plenum 345 and the evaporator 350. As illustrated, the fan 340 is positioned between the divider wall 55 and the display surface 250 (e.g., at the corner joining the first portion and the sidewall 280), such that the fan 340 is disposed at an oblique angle within the second air passageway 330 at a corner of the passageway 330. The plenum 345 is positioned in the vertical segment of the passageway 330 and transitions the airflow to the adjoining horizontal segment of the passageway 330. The plenum 345 is spaced vertically below the fan 340 and includes a plenum inlet 360 and a plenum outlet 365 that is fluidly coupled to the evaporator 350.

As best shown in FIGS. 1 and 4A, the plenum 345 generally tapers or narrows in the downstream direction from the inlet 170 (i.e. moving in the airflow direction along the air passageway 330). The illustrated plenum 345 has the same shape or profile as the plenum 145, and is oriented vertically with the inlet 360 receiving air from above the plenum 345. That is, the left-most wall of the plenum 345 (as viewed in FIG. 4A) defines a portion of the plenum 145 (and the passageway 330) that has several sections with bends joining the sections such that the wall has a stepped profile. With reference to an imaginary vertical plane extending along the divider wall 55, each section is oriented at the same or similar angle relative to the vertical plane as the sections described with regard to the first plenum 145 relative to the horizontal plane. More generally, the stepped profile of the illustrated plenum 345 directs the airflow from a generally vertical flow to a horizontal flow within the passageway 330. As shown in FIG. 4A, the evaporator 350 is disposed below and generally adjacent the lower surface 285 of the well 275, and is oriented at a non-zero angle (e.g., 1-10 degrees) relative to horizontal. A fluid outlet 375 (e.g., a drain feature) permits discharge of condensate fluid that may form on or in the evaporator 350.

Figure 11B:
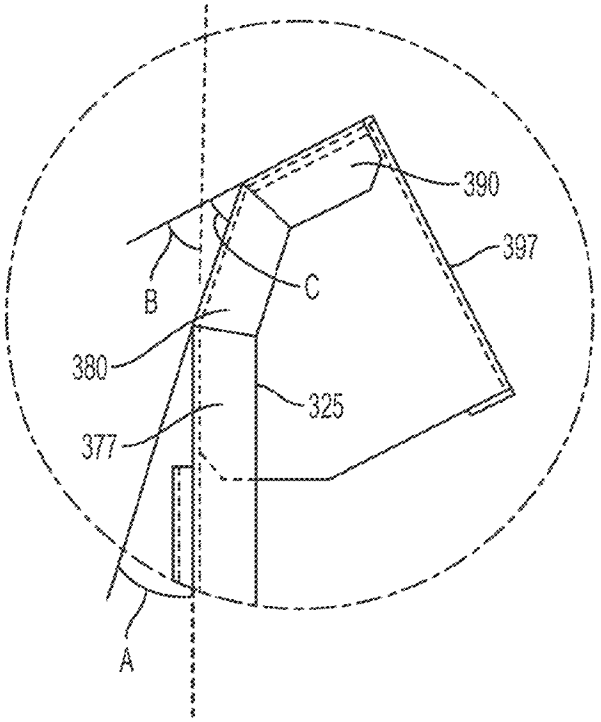
FIG. 11B is a side view of a portion of the air discharge grill of FIG. 10.
Figure 11A:
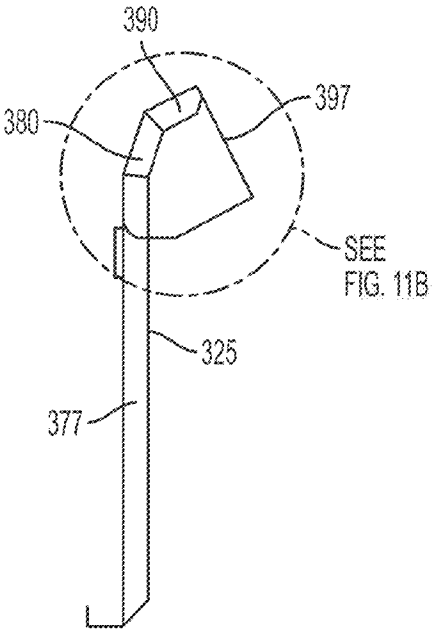
FIG. 11A is a side of the air discharge grill of FIG. 10.
Figure 12:
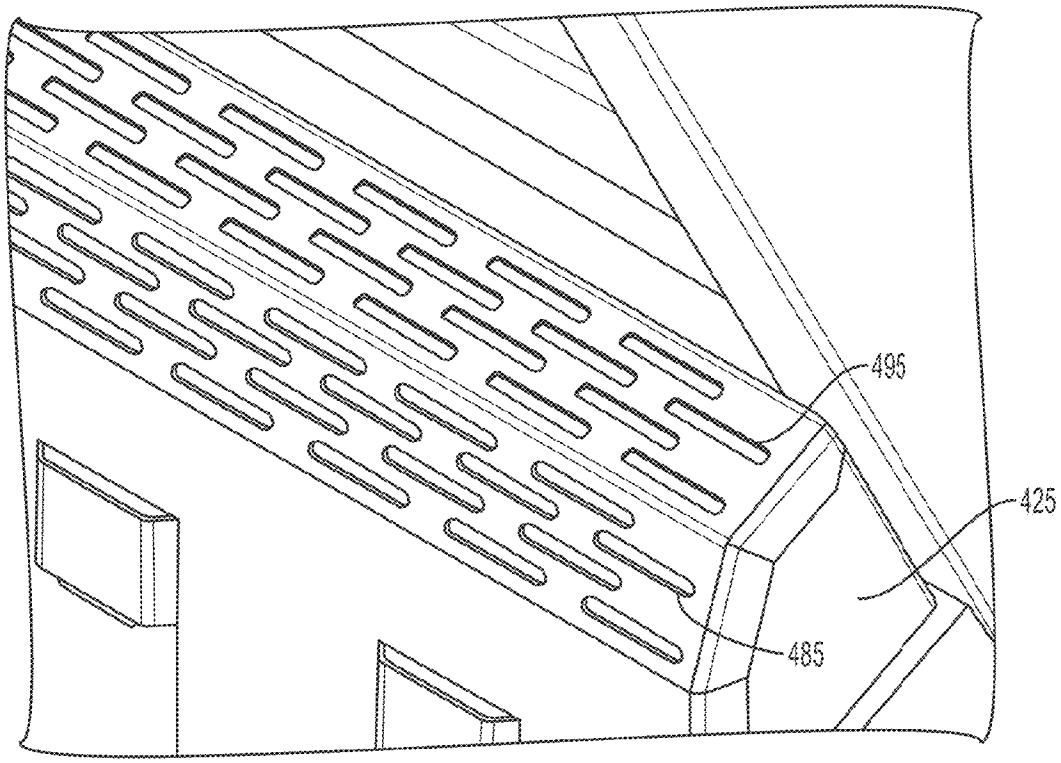
FIG. 12 is a perspective view of another exemplary air discharge grill.
Figure 13:
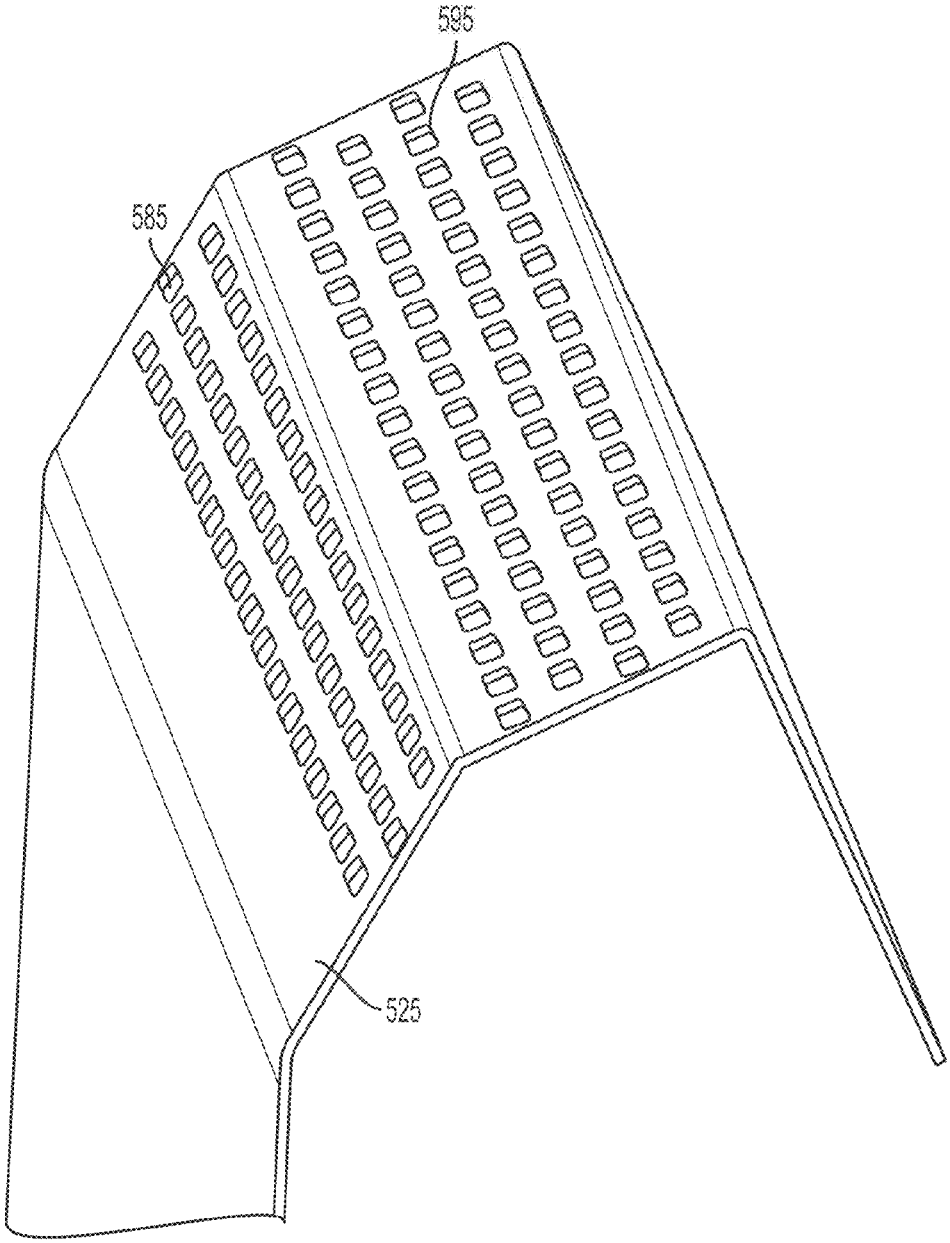
FIG. 13 is a perspective view of another exemplary air discharge grill.

With reference to FIGS. 10-13, the illustrated discharge grill 325 includes a first discharge segment 377 with first discharge apertures 378, a second discharge segment 380 that has second discharge apertures 385, a third discharge segment 390 that has third discharge apertures 395, and a fourth discharge segment 397 that is provided without apertures. As shown in FIGS. 10-11B, the discharge grill 325 includes vertically-arranged first discharge apertures 378 that provide airflow communication between the passageway 330 and the well 275. The illustrated second discharge segment 380 has four rows of second discharge apertures 385, and the third discharge segment 390 has two rows of third discharge apertures 395. The illustrated second discharge apertures 385 are generally smaller in size than the third discharge apertures 395, although the apertures 385, 395 can be the same size or different sizes (larger or smaller than the other). FIG. 12 shows another exemplary discharge grill 425 that includes four rows of second discharge apertures 485 and four rows of third discharge apertures 495, with the respective second and third discharge apertures 485, 495 arranged in rows that are axially offset relative to adjacent rows. FIG. 13 shows yet another exemplary discharge grill 525 that includes three rows of second discharge apertures 585 and four rows of third discharge apertures 595, with the respective second and third discharge apertures 585, 595 arranged in rows that are axially offset relative to adjacent rows. Other arrangements of the respective apertures (quantity of rows, quantity of apertures, size of apertures, shape of apertures, etc.) are also possible and considered herein. For example, the second discharge apertures 485 and the third discharge apertures 495, as illustrated in FIG. 12, are elongated axially relative to the second discharge apertures 385 and the third discharge apertures 395 as illustrated in FIG. 10.

Referring back to FIGS. 10-11B, the first discharge segment 377 is oriented substantially vertically, and the second discharge segment 380 and the third discharge segment 390 are angled relative to one another and relative to a vertical plane defined by the first discharge segment 377. For example, the second discharge segment 380 is oriented at an angle A (e.g., approximately 15-45 degrees) relative to the vertical plane, and the third discharge segment 390 is oriented at an angle B (e.g., 50-85 degrees) relative to the vertical plane and at an angle C (e.g., 30-60 degrees). In the exemplary grill 325, the angle C can be approximately 40-50 degrees (e.g., 45 degrees). The fourth discharge segment 397 is oriented perpendicular to the third discharge segment 390, and can include a short lip or flange.

Except as described above with regard to the shape, size, and orientation of the apertures, the grills 425, 525 described relative to FIGS. 12 and 13 are the same as the grill 325.

Figure 14A:
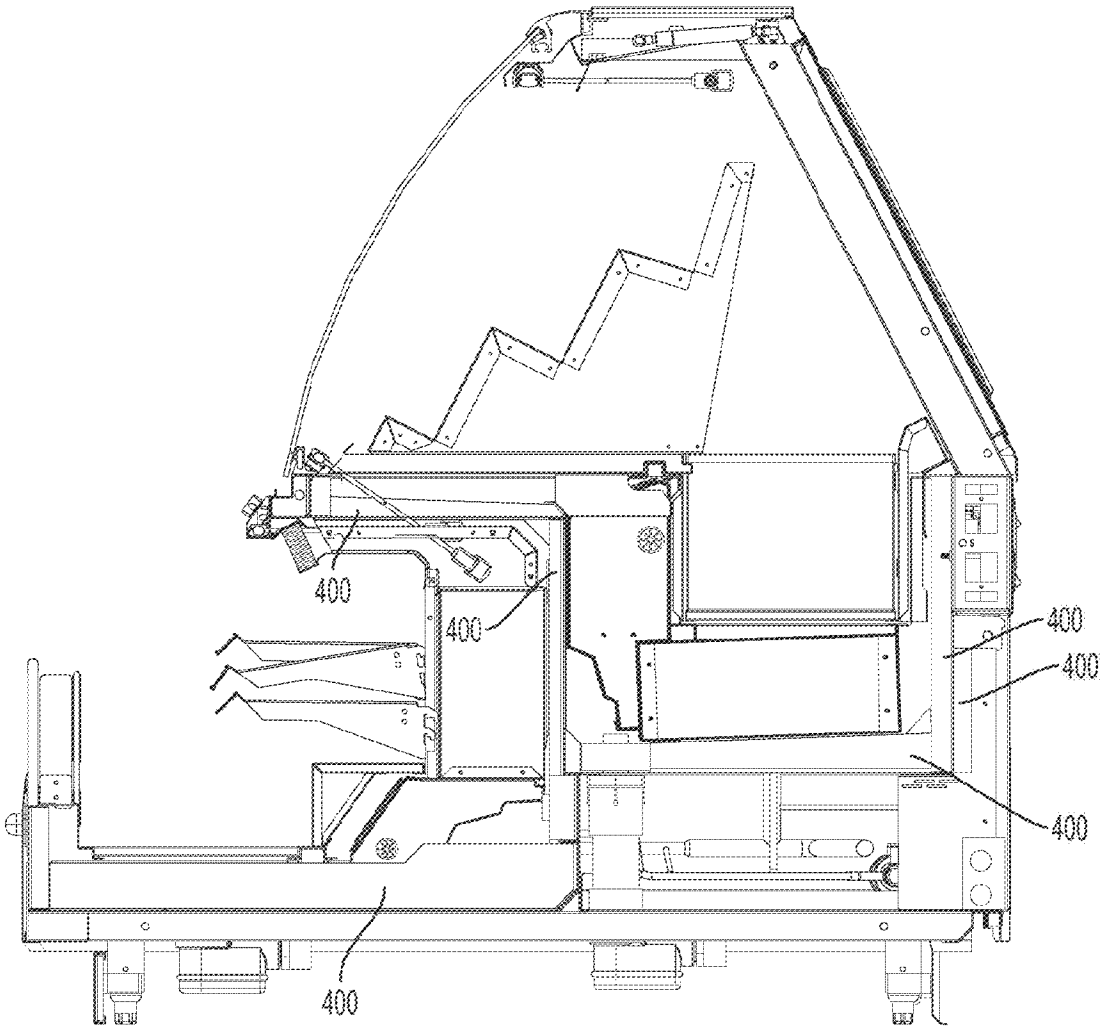
FIG. 14A is a side view of the merchandiser of FIG. 1 illustrating thermal isolation disposed adjacent the case sections.
Figure 14C:
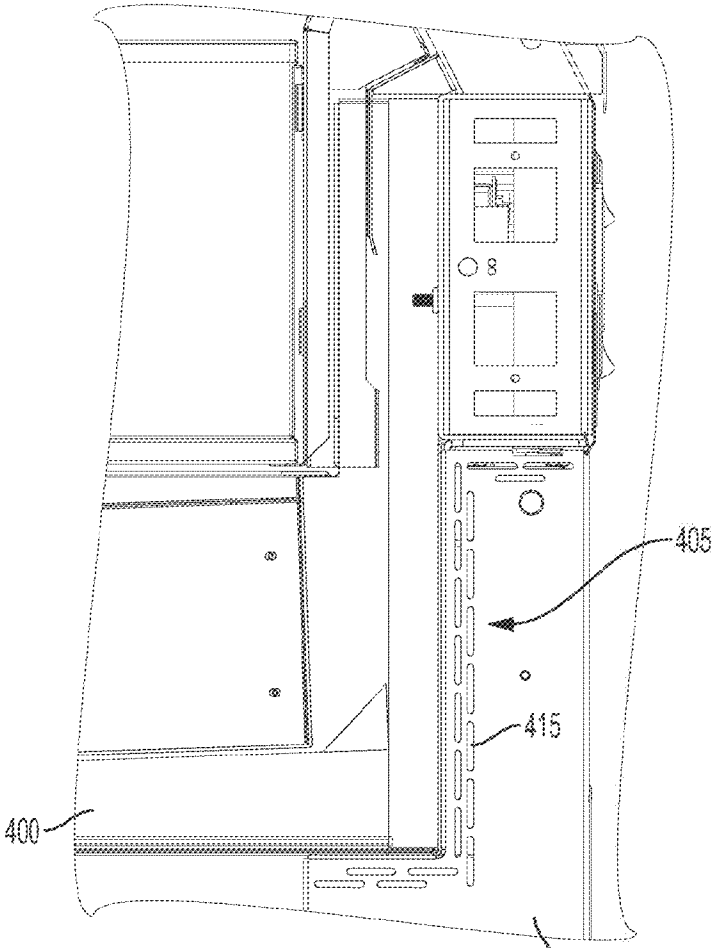
FIG. 14C is a side view of a portion of the thermal isolation between the second case section and an ambient environment.
Figure 14B:
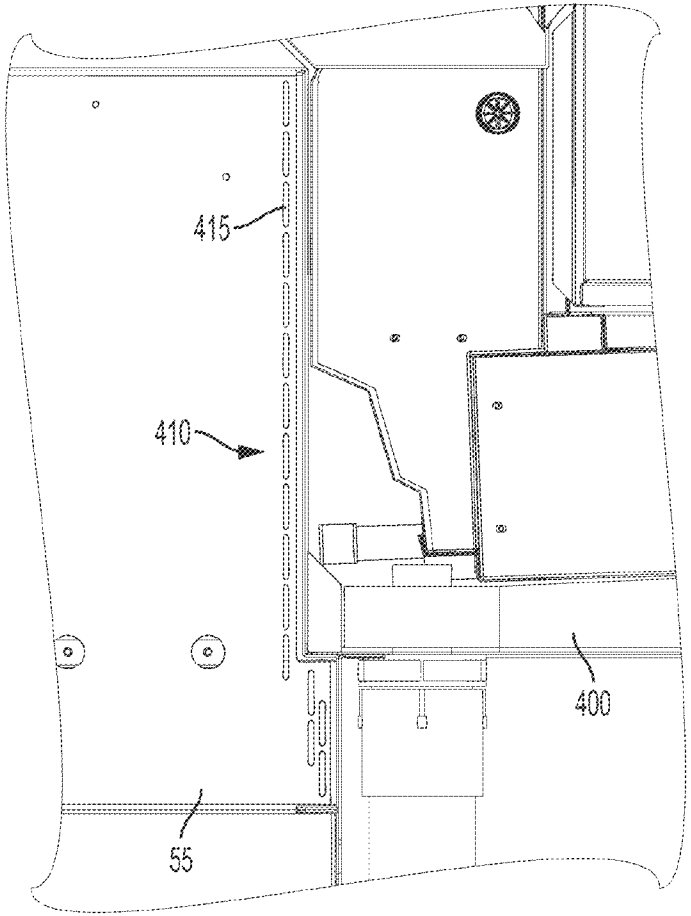
FIG. 14B is a side view of a portion of the thermal isolation between the first case section and the second case section.

With reference to FIGS. 14A-C, the frame 210 of the second case section 35 is supported above the base 20 and the first canopy 65 of the first case section 25. The first case section 25 and the second case section 35 are separated by the first air passageway 95 and at least a portion of the second air passageway 330. In addition, thermal insulation 400 is disposed within the base 20 between the first air passageway 95 and the base 20, the first air passageway 95 and the second air passageway 330, and the second air passageway 330 and the base 20 to prevent cooling of the base 20 by air within the first and second air passageway 95, 330. The thermal insulation 400 may be any type of thermally insulating material. Portions of the insulation 400 also define the bounds of the first case section 25 and the second case section 35. Furthermore, the base 20 of the merchandiser 10 includes a first thermal isolation section 405 and a second thermal isolation section 410. As illustrated, the first thermal isolation section 405, 405 is defined by apertures 415 in the base 20 (FIG. 14C), while the second thermal isolation section 410 is defined by apertures 415 in the divider wall 55.

In operation, the first refrigeration system 135 is configured to maintain operational temperatures within the first product display area 30. Air is drawn into the first airflow inlet 80 and directed through the first air passageway 95 and the bypass channel 105 by pressure differentials generated by the fan 140. The fan 140 generates a negative pressure differential at the first airflow inlet 80 to draw air into the first air passageway 95, and subsequently drives the air into the plenum 145. The stepped profile of the plenum 145 distributes the airflow substantially evenly and efficiently across refrigeration coils 155 of the evaporator 150. The airflow also is directed through the second plenum outlet 180 to the bypass channel 105. Any water that is formed on or in the evaporator 150 (e.g., during defrost) is directed to the fluid outlet 165 for removal (e.g., via a drain).

Figure 9:
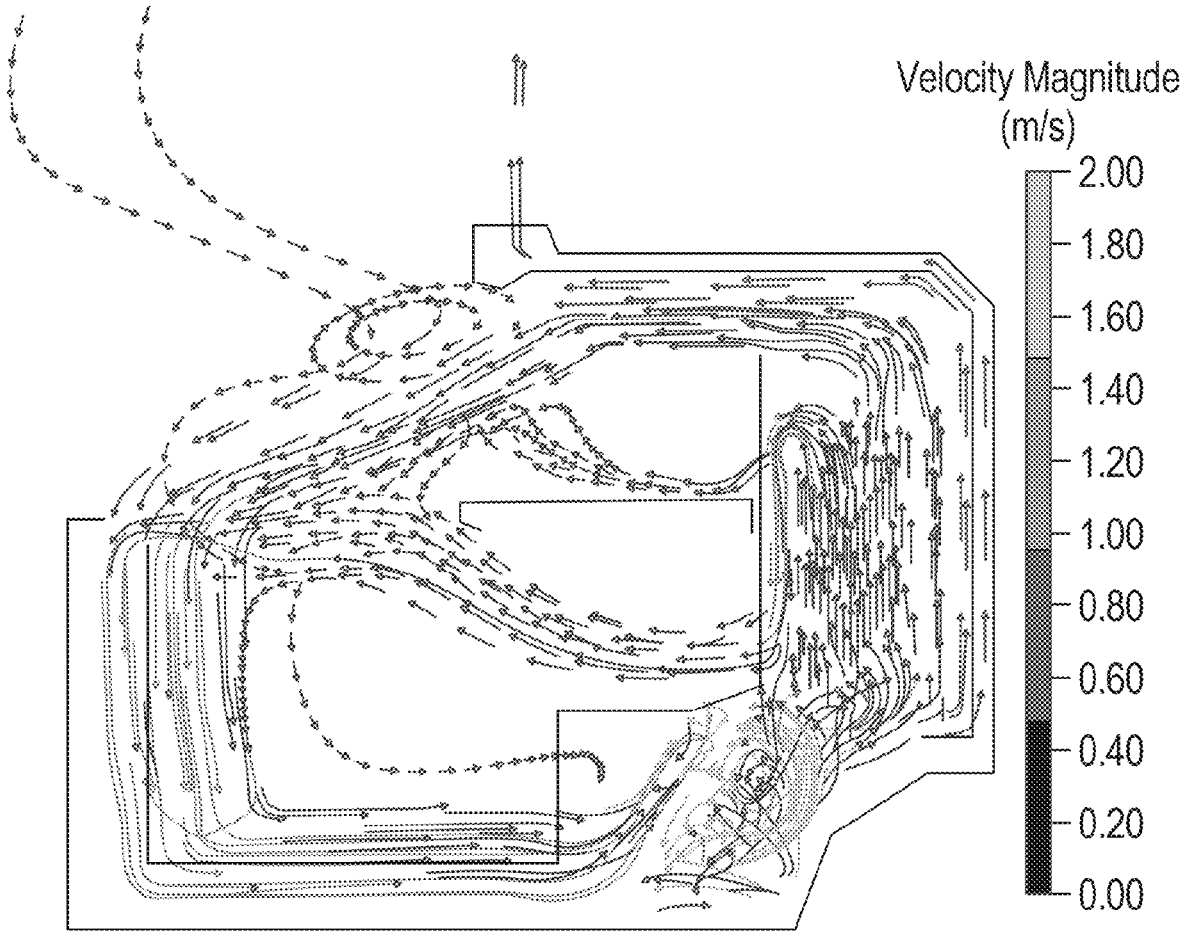
FIG. 9 is an image of an airflow simulation of the first case section.

The airflow is cooled or refrigerated within the evaporator 150. With reference to FIG. 9, a portion of the airflow is discharged from the evaporator 150 toward the first airflow outlet 85 to direct air across the opening 130 of the first case section 25. The upper edge 90 defines a smooth angle along which air flows from the outlet 85 to minimize turbulent airflow from the first airflow outlet 85. In other words, the first airflow outlet 85 is configured to define a uniform refrigerated air curtain across opening 130. The air curtain acts to maintain refrigerated air within the first case section 25, while also preventing ambient air from entering the first case section 25, as illustrated by the airflow simulation of FIG. 9.

Another portion of the airflow exiting the evaporator 150 flows through the gap 205 between the rear panel 60 and the evaporator 150 into the first product display area 30 via the upper and lower airflow apertures 115, 120 in the rear panel 60. This air is primarily contained within the first product display area 30 by the air curtain and helps to maintain a desired temperature within the first display area 30.

With reference to FIG. 8, the air flowing through the bypass channel 105 is not conditioned by the evaporator 150 and is directed over the heater 110 and toward the heated airflow outlet 100. The heated air exits via the heated airflow outlet 100 and flows along the first glass panel 235 of the second case section 35 to inhibit or limit formation of condensation and/or fog on the first glass panel 235.

The second refrigeration system 335 maintains desired temperatures within the second product display area 40. Air is drawn into the second airflow inlet 315 and directed through the second air passageway 330 by pressure differentials generated by the fan 340. The fan 340 generates a negative pressure differential at the second airflow inlet 315 to draw air into the second air passageway 330, and subsequently drives the air into the plenum 345. In addition, the stepped profile of the plenum 345 distributes the airflow substantially evenly and efficiently into the evaporator and across the refrigeration coils 355. Any condensation that forms within the evaporator 350 is directed to the fluid outlet 375 due to the tilt of the evaporator 350 relative to horizontal.

Figure 15:
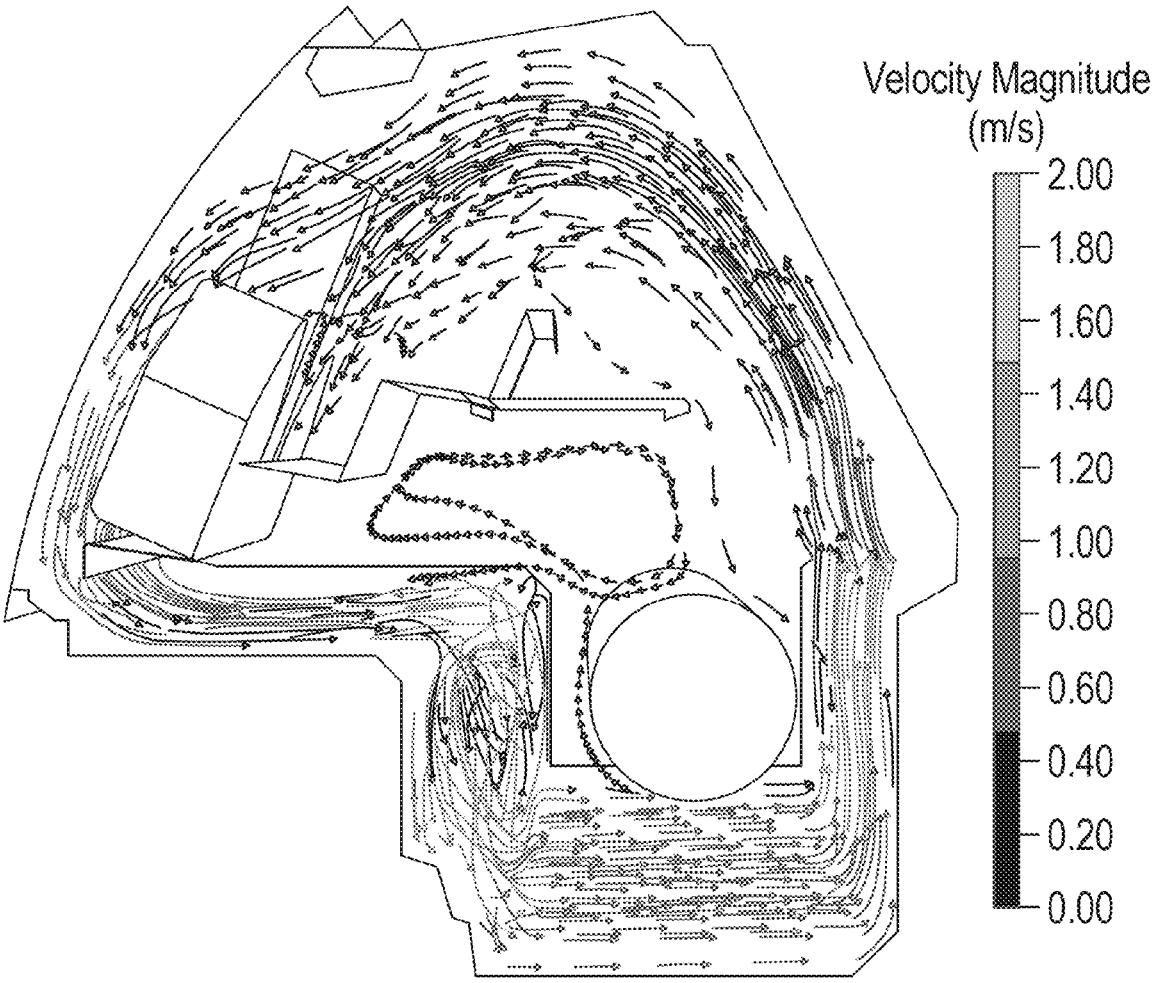
FIG. 15 is an image of an airflow simulation of the second case section.

The refrigerated air is discharged from the evaporator 350 and through one of the segments of the discharge grill 325. The discharge grill 325 directs the refrigerated airflow substantially upward and forward toward the glass panel 235 at different angles (based on the angular relationship between the segments 380, 390. A smaller portion of airflow is directed into the well 275 or the area behind the rack 265. More specifically, different volumes of air are discharged by each discharge segment based on the amount of cooling needed in different areas of the case 15. For example, the airflow defined by the second discharge segment 380 is directed through a central portion of the second case section 35, whereas the airflow defined by the third discharge segment 390 generally upward over the rack or shelving unit 265 as illustrated by the airflow simulation of FIG. 15.

The thermal insulation 400 and thermal isolation sections 405, 410 limit undesired refrigerant heat loss to the base 20 and potentially damaging condensation. For example, the thermal insulation 400 generally has poor thermal conductivity, which limits conductive heat transfer. The thermal isolation sections 405, 410 limit heat transfer (i.e. increase resistance to heat transfer) by creating a thermal break between different portions of the merchandiser 10. The thermal insulation 400 and the isolation sections 405, 410 cooperatively decrease heat transfer within the merchandiser 10 such that the overall size of the merchandiser 10 can be reduced without foregoing desirable refrigeration characteristics.

The plenum profiles increase the efficiency of cooling within the respective evaporators by more evenly distributing air within the evaporators 150, 350. The profiles also generate a high velocity airflow that can reduce the power input of other components of the merchandiser 10 and, with regard to the bypass channel 105, avoid having a separate fan that generates the airflow across the glass panel 235. Because the air flowing through the outlet 100 bypasses the evaporator 150, only a relatively small amount of heat is needed to reach a temperature that inhibits formation of condensation on the glass panel 235.

The airflows generated within and through the first and second case sections 25, 35, and the components that generate or direct the airflows through the merchandiser 10, cooperate to provide a compact merchandiser 10 that has an overall height (from the support surface to the top of the second canopy 245) of approximately 52 inches without extending further in to the retail setting (e.g., the merchandiser can have a depth of approximately 51 inches). The small footprint of the merchandiser 10, compared to the footprint of existing merchandisers, frees up valuable retail floor space. Also, the efficiency gains resulting from the above described merchandiser 10 results in a significant decrease in overall energy consumption by the merchandiser 10 on the order of 40-45% compared to existing merchandisers.

Various features of the invention are set forth in the following claims.

The invention claimed is:

1. A refrigerated merchandiser comprising:

a case including a base;

a case section supported by the base and that defines a product display area partially enclosed by a glass panel at or adjacent a front of the case;

an air passageway supporting a fan and fluidly communicating an airflow inlet with an airflow outlet, the air passageway at least partially defined by a refrigeration system including an evaporator; and a discharge grill defining the airflow outlet and disposed adjacent a rear of the case section opposite the glass panel, the discharge grill including a first discharge segment and a second discharge segment extending from the first discharge segment, wherein each of the first discharge segment and the second discharge segment is oriented to face the product display area and the second discharge segment is oriented at a non-zero angle less than 90 degrees relative to the first discharge segment to direct a refrigerated airflow through the respective first and second discharge segments to different portions of the product display area.

2. The refrigerated merchandiser of claim 1, wherein each of the first discharge segment and the second discharge segment includes a plurality of apertures.

3. The refrigerated merchandiser of claim 2, wherein the first discharge segment directs a portion of the refrigerated airflow toward a center portion of the product display area and the second discharge segment directs a portion of the refrigerated airflow substantially upward and forward into the product display area.

4. The refrigerated merchandiser of claim 2, wherein the sum of the plurality of apertures of the first discharge segment differs from the sum of the plurality of apertures of the second discharge segment such that different volumes of air are discharged by the first discharge segment and the second discharge segment.

5. The refrigerated merchandiser of claim 2, wherein one or both of the shape and size of the plurality of apertures of the first discharge segment differs from one or both of the shape and size of the plurality of apertures of the second discharge segment, respectively, such that air is discharged from the first and second discharge segments at different velocities.

6. The refrigerated merchandiser of claim 1, further comprising a well formed below the product display area and above the evaporator, wherein the discharge grill includes a third discharge segment angled relative to the first discharge segment and the second discharge segment and including apertures that provide airflow communication between the air passageway and the well.

7. The refrigerated merchandiser of claim 6, wherein the third discharge segment is vertical or substantially vertical and each of the first and second discharge segments is non-vertical and non-horizontal when the case is oriented on a support surface.

8. The refrigerated merchandiser of claim 6, wherein the well is defined by walls separate from the product display area.

9. The refrigerated merchandiser of claim 6, further comprising a cover enclosing the well.

10. The refrigerated merchandiser of claim 1, wherein the case includes frame uprights opposite the glass panel, and wherein the airflow outlet is disposed adjacent a base or lower end of the frame uprights.

11. The refrigerated merchandiser of claim 10, wherein the first discharge segment is disposed adjacent the frame uprights and the second discharge segment is disposed inward from the first discharge segment relative to the frame uprights.

12. The refrigerated merchandiser of claim 1, wherein the first discharge segment is disposed adjacent a rear of the case and second discharge segment is disposed closer to the glass panel than the first discharge segment.

* * * * *